United States Patent [19]

Graham et al.

[11] 4,116,097

[45] Sep. 26, 1978

[54] CUTTING MACHINE INCORPORATING MEANS FOR TRANSFERRING CUT PARTS AND SCRAP

[75] Inventors: Gordon Judson Graham, Reading; John Frederick Martin, South Essex; Douglas Hodgen Crowell, Beverly, all of Mass.

[73] Assignee: USM Corporation, Farmington, Conn.

[21] Appl. No.: 830,459

[22] Filed: Sep. 6, 1977

[51] Int. Cl.[2] ..... B26F 3/00

[52] U.S. Cl. ..... 83/155; 83/157; 83/177; 83/520

[58] Field of Search ..... 83/177, 53, 925 CC, 83/157, 155, 409, 277, 155.1, 520

[56] References Cited

U.S. PATENT DOCUMENTS

| | | | |
|---|---|---|---|
| 3,449,991 | 6/1969 | Daniels | 83/277 X |
| 3,701,299 | 10/1972 | Stumpf | 83/925 CC |
| 3,978,748 | 9/1976 | Leslie et al. | 83/177 X |

*Primary Examiner*—J. M. Meister

*Attorney, Agent, or Firm*—Carl E. Johnson; Richard B. Megley; Vincent A. White

[57] ABSTRACT

Sheet cutting means, preferably of the fluid jet nozzle type, is programmed for predetermined X–Y operation on a workpiece supported on a series of taut, unidirectional, spaced wires arranged substantially as a planar bed. As the nozzle is shifted in an X–Y plane parallel to and above the work, a drain cup is correspondingly moved beneath the wire bed to receive the spent pressure fluid for recirculation or other disposition. A transfer means comprised of uniformly spaced belts is movable heightwise between the wires to convey all cut parts and scrap, collectively in unchanged relation, to an unload station when the nozzle and cup are out of the way. Preferably a television screen displays for an attendant at the unloading zone of the machine a replica of the cut work as pre-programmed to facilitate his identification and disposition of the different cut-outs, for instance, shoe soles.

9 Claims, 9 Drawing Figures

CUTTING MACHINE INCORPORATING MEANS FOR TRANSFERRING CUT PARTS AND SCRAP

BACKGROUND OF THE INVENTION

This invention relates to machines for fluid jet cutting of sheet material to provide discrete workpieces of predetermined shape or shapes.

More particularly the invention is concerned with providing an improved fluid jet type cutting machine operable efficiently on successive sheets or groups of sheets of material, and having means for removing the cut parts and scrap in substantially unchanged relative position, to an unloading zone thus facilitating sorting and/or other subsequent processing.

Prior usage of high pressure fluid jets for cutting purposes is well-known. Some of its advantages are cited, for example, in U.S. Pat. No. 3,877,334 issued in the name of Heinz J. Gerber. He also mentions techniques and cutting tables as disclosed in other patents for dealing with limp sheet material to be cut, and refers to automatic means, such as computer control, for directing the cutting pattern desired. U.S. Pat. No. 3,625,813 discloses a fluid jet for cutting a wet paper web supported on a screen of a paper making machine.

A cloth cutting system employing a laser beam, but in some digitizer and work control aspects possibly analogous to the organization of the present invention, is disclosed along with prior art in U.S. Pat. No. 3,769,488 issued in the name of R. L. Hasslinger.

The present invention recognizes the importance, in a cutting machine of the fluid jet type, of providing improved sheet supporting and feeding means before, during, and subsequent to the cutting in order to enhance production.

SUMMARY OF THE INVENTION

In view of the foregoing it is an object of this invention to provide, in combinaton with programmable fluid jet cutting means operable on flexible or even semi-rigid sheet material, a work-supporting bed for holding the material as it is cut, mechanism for positioning the material onto the bed, and other mechanism for removing the cut parts and scrap material intact from the bed to facilitate subsequent processing.

Another and more specific object is to provide an economical, durable and lightweight cutting bed providing little or no interference with operation of a water jet and its cooperating receiver of spent fluid.

To these and other ends, there is herein shown by way of illustration of the invention a cutting bed frame extending between sheet loading and unloading zones, the frame tautly supporting spaced wires extending in parallel between the zones. Preferably, and as herein shown, the wires are disposed substantially in a horizontal plane lying between operative positions of a programmable water jet cutting nozzle and its correspondingly movable drain or effluent receiver. For facilitating subsequent processing, a transfer mechanism is relatively movable heightwise of the wire bed to lift, intact, the cut parts and scrap material of each sheet which has been cut upon the bed, the transfer mechanism being thereupon movable thus to shift the parts and material in unchanged relative positions to the unloading zone. This minimizes non-cutting time of the machine and insures easier identification of the different cut parts at the unload zone.

BRIEF DESCRIPTION OF THE DRAWINGS

The foregoing and other features of the invention will now be more particularly described in connection with an illustrative embodiment and with reference to the accompanying drawings thereof, in which.

DESCRIPTION OF THE PREFERRED EMBODIMENT

Figure 1:
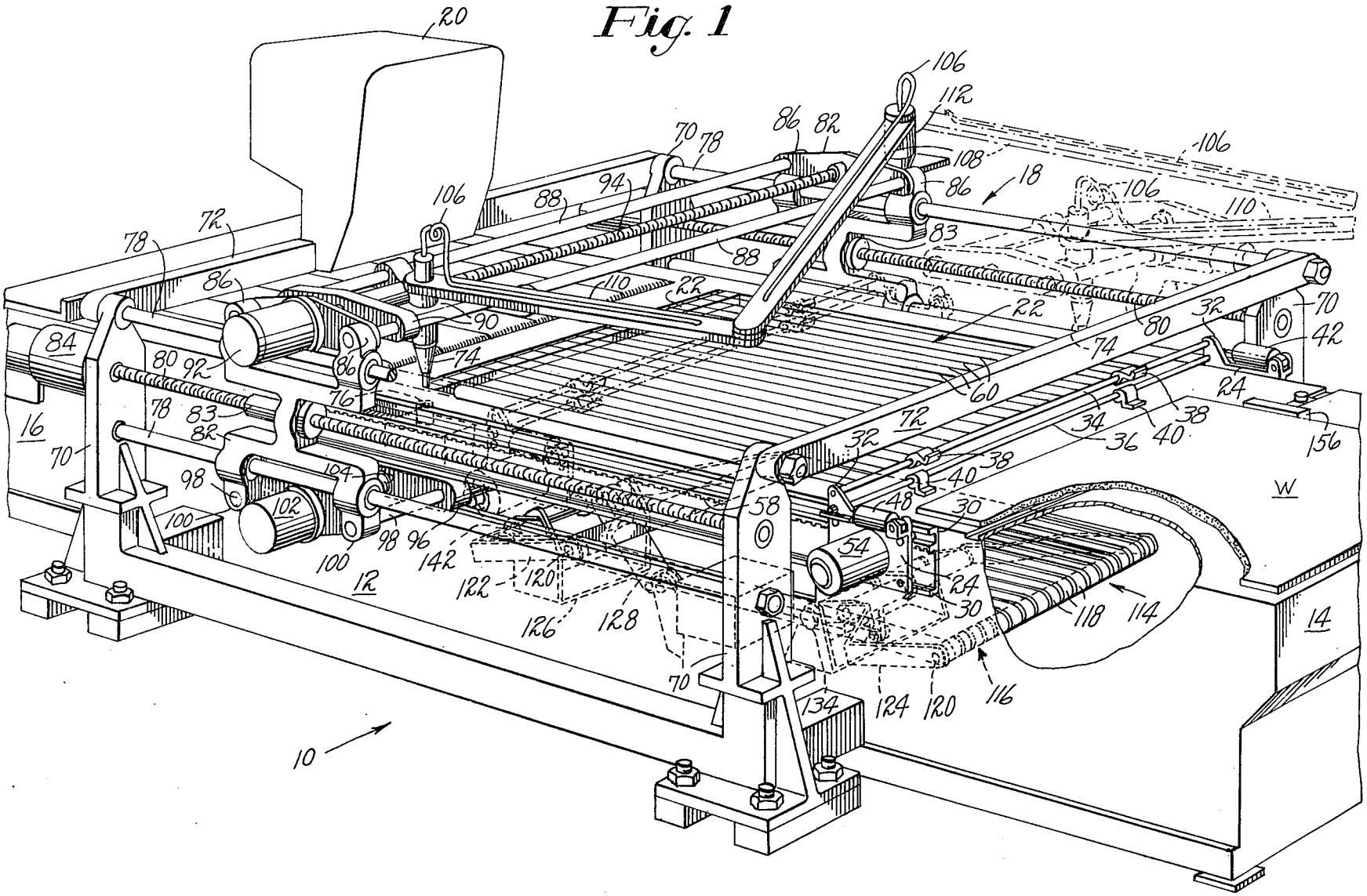
FIG. 1 is a perspective view of a fluid jet cutting machine operable on sheet material, for example that from which soles are to be cut, the machine being shown with its jet nozzle in inoperative position and a sheet to be cut disposed upon a loading zone.
Figure 2:
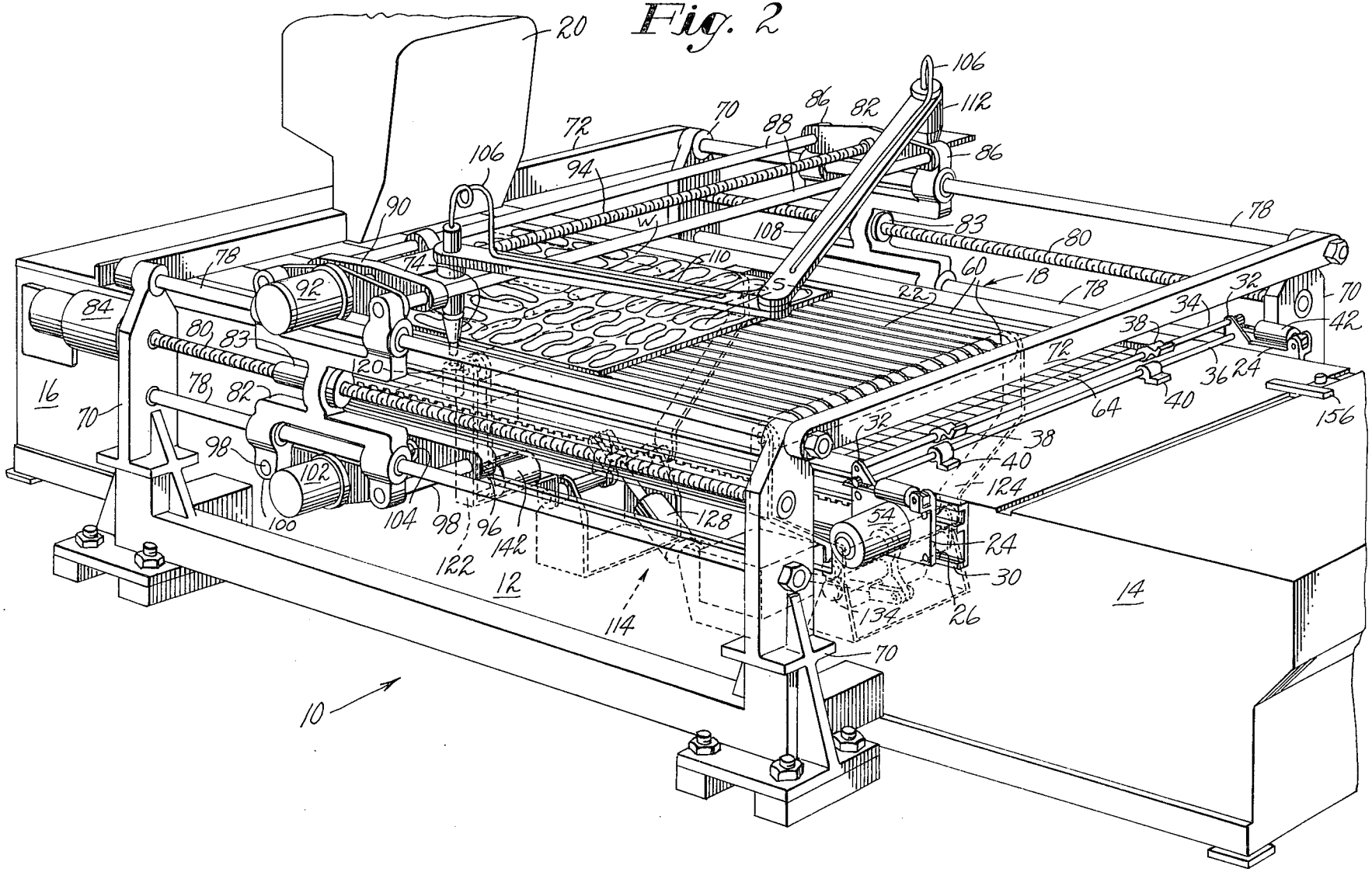
FIG. 2 is a view similar to FIG. 1 except that work feeding clamps have transferred the sheet material onto a cutting bed under the nozzle and retracted to loading position whereupon the pressurized jet from the nozzle has, under the control of computer or other automatic programming means, cut the soles as indicated.
Figure 3:
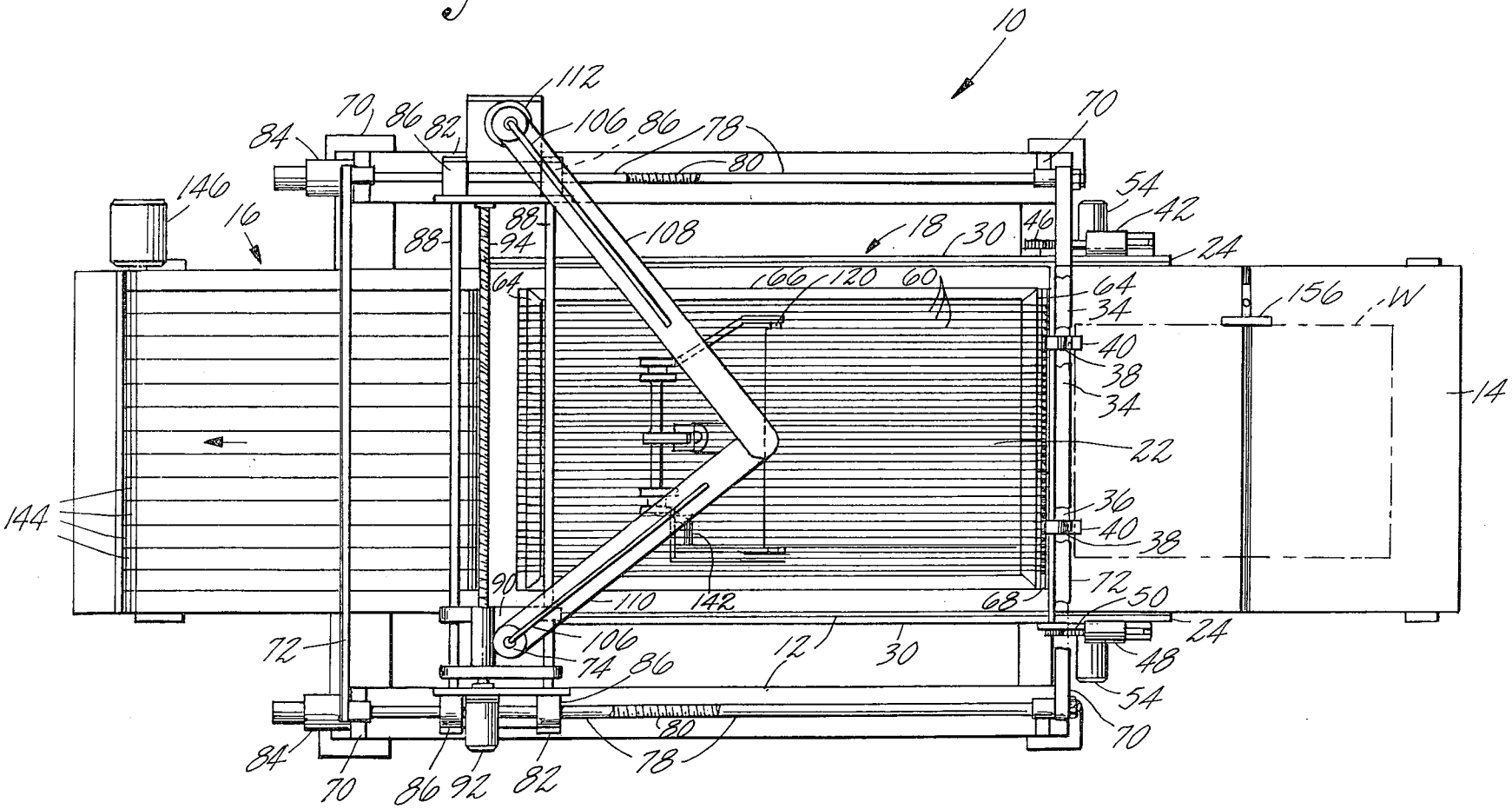
FIG. 3 is a plan view, with portions omitted, of the machine shown in FIGS. 1 and 2 and showing a cutting bed extending between load and unload zones.

Referring first to FIGS. 1–3, a fluid jet cutting machine generally designated 10 comprises a rectangular frame 12 having at one end a loading zone or table 14 for receiving single or stacked sheets of material W to be cut. At the other end of the frame 12 is an unloading zone 16 for receiving intact the cut parts and scrap which have been produced in a cutting region 18 extending between the two zones at substantially the same level. The machine will be described in connection with cutting soles S from the material W, the soles frequently being cut from pairs of superposed sheets, but it will be apparent that usage of the machine is not thus restricted either as to the shape of articles to be cut or the number of sheets simultaneously to be cut. For convenience the material W is herein assumed to be one sheet W.

For a given sheet W a digitizing and programming means (not shown) preferably associated with the machine 10 will have predetermined a cutting program insuring maximum yield of the articles (soles S) of given size and shape and/or different sizes and shapes to be cut therefrom thus providing a minimum of waste or scrap. Preferably, too, a television screen 20 mounted adjacent to the unloading zone 16 will display a replica of the pre-programmed arrangement of the different soles to be cut in the region 18 so that, when they subsequently arrive for the attention of an unloading attendant, he may conveniently identify and sort or otherwise appropriately process them.

Figure 4:
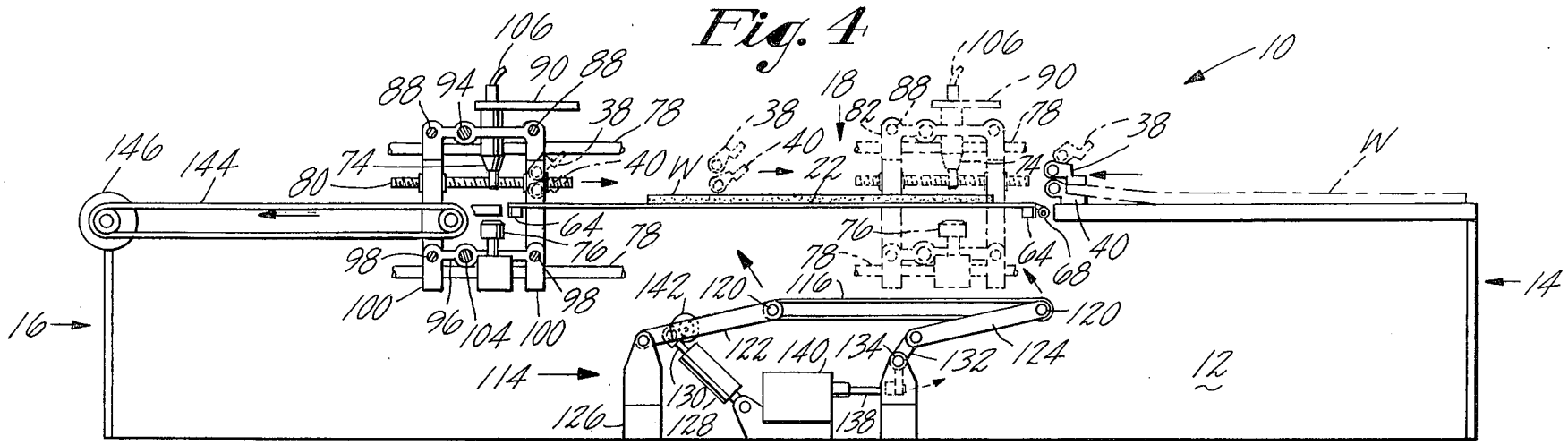
FIG. 4 is a schematic view in side elevation of portions of the machine and showing work transfer mechanism in inoperative position beneath the cutting bed.
Figure 6:
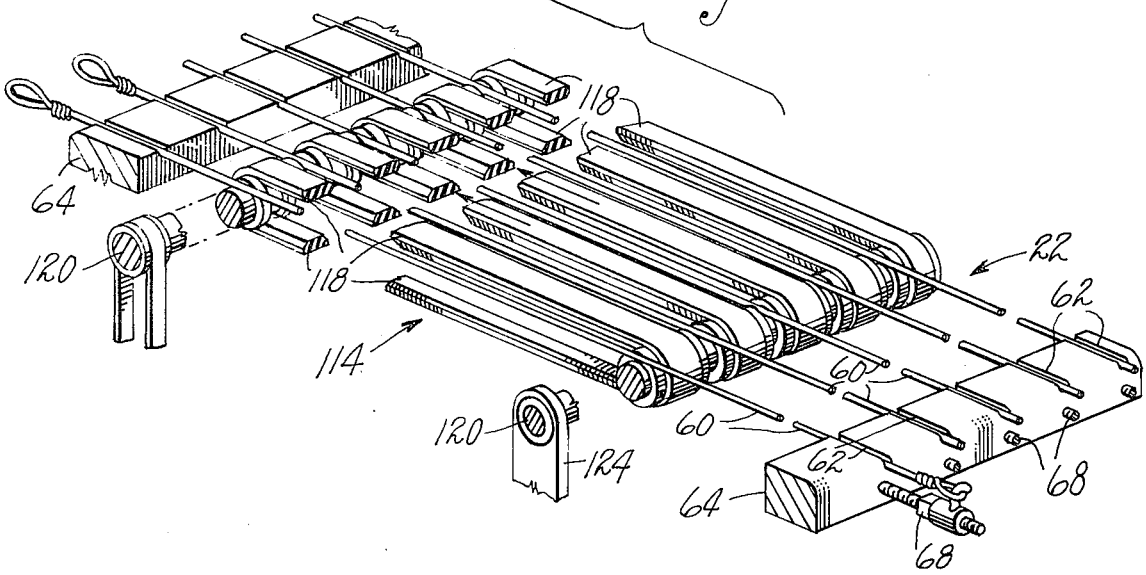
FIG. 6 is a perspective view on a larger scale of the transfer mechanism raised as shown in FIG. 5 and tilted relative to the cutting bed.
Figure 7:
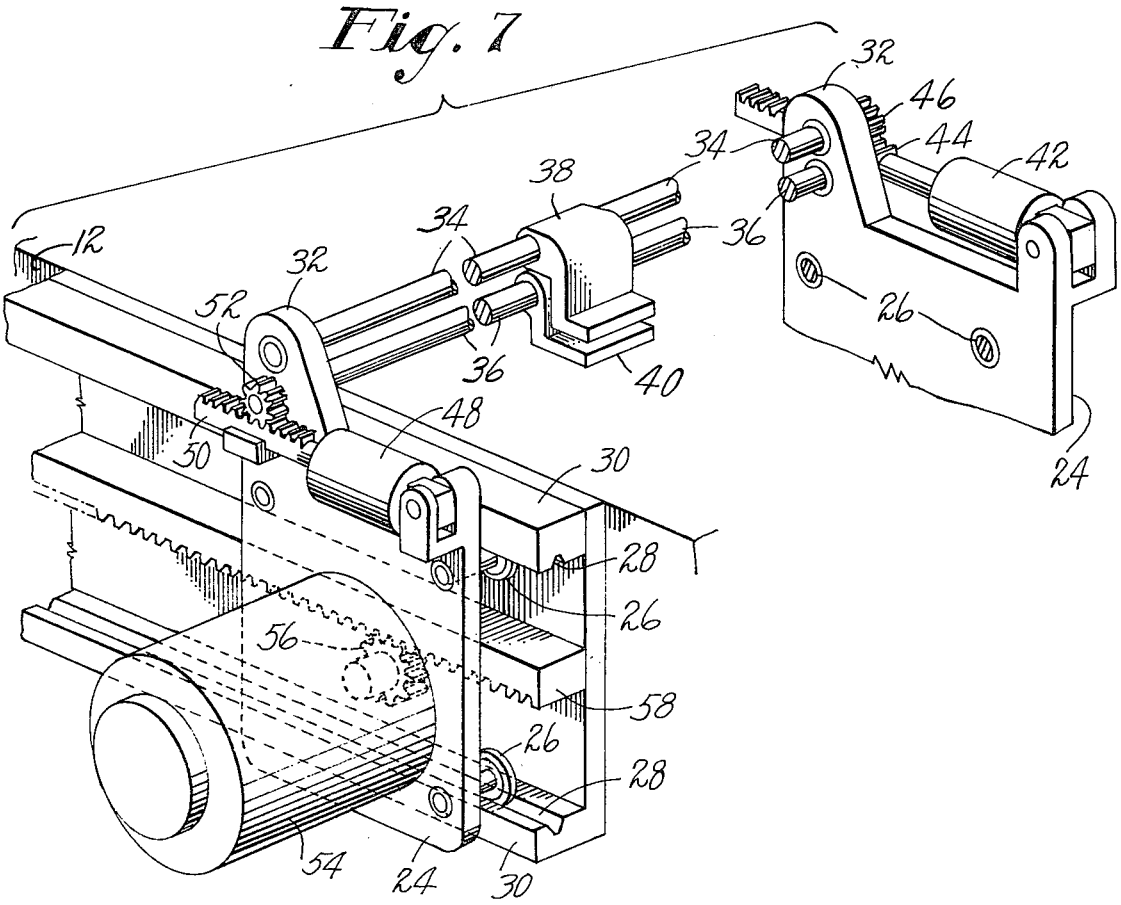
FIG. 7 is an enlarged perspective view, with portions broken away, of the sheet clamping and feeding mechanism.

A loaded sheet W is horizontally advanced from its initial registered position on the table 14 to a stationary operating position upon a novel cutting bed 22 (FIGS. 1–3, 6) in the region 18 by mechanism next to be explained. A pair of laterally spaced side plates 24,24 (FIGS. 1–3, 7) is fitted, respectively, with pairs of guide rolls 26,26 arranged to roll in horizontal grooves 28 formed in guides 30,30 secured to opposite sides of the frame 12, respectively, upwardly projecting lugs 32 of the plates 24 are bored rotatably to carry parallel cross rods 34,36 one above the other. As shown in FIGS. 1 and 7, the upper rod 34 fixedly supports a pair of widthwise spaced clamps 38,38 each of which is arranged to cooperate with one of a similar pair of spaced clamps 40,40 secured on the rod 36. The clamps 38 are moved toward and from gripping relation with respect to a leading margin of the sheet W and the lower clamps by means of a motor 42 secured on one of the plates 24. For this purpose the motor 42 actuates a rack 44 meshing with a pinion 46 pinned on an end of the rod 34. Similarly, the clamps 40 are operated to and from their closed positions by a motor 48, a rack 50, and a pinion 52 connected to an end of the lower rod 36. Accordingly it will be understood that when the clamps 38,40 have closed and seize a leading margin of the thus predeterminedly located work on the loading table, they will be simultaneously advanced horizontally with the sheet by means of then energized motors 54,54 (one shown in FIGS. 1,2) carried by the plates 24, respectively, the motors 54 each rotatably driving a pinion 56 (FIG. 7) meshing with a rack 58 extending horizontally and secured to each side of the frame 12. Means, such as a stop switch (not shown), is provided for deenergizing the motors 42,48 to release the work when it has arrived in predetermined position over the bed 22 as indicated in FIG. 4. The motors 54 are thereafter also deenergized when the clamps are free of the work, and then automatically energized for reverse rotation to retract the open clamps and the rods 34,36 to their starting position for the feeding of a next sheet W.

The bed 22 desirably comprises a plurality of taut wires 60, uniformly spaced widthwise in a plane, are of small diameter (about .040") and have good tensile strength. They may, for instance, be of the type commonly known as stainless steel music wire and be spaced on the order of one inch apart. The wires extend substantially from the loading table 14 to the unloading zone 16, ends of the wires preferably extending in aligned grooves 62 (FIG. 7) respectively, formed in parallel cross bars 64,64 of a rectangular supporting frame 66 (FIG. 3) detachably secured to the main frame 12. Corresponding ends of the wires may be attached, respectively, to a series of rotatably adjustable take-up bolts 68 (FIGS. 3 and 6) provided for eliminating any slack in each of the wires.

Though not herein shown it will be understood that, for preventing displacement of the sheet W on its wire bed 22 during cutting, a suitable hold down means is provided. This may, for instance, be in the known forms of a vacuum hold-down, grippers arranged to releasably hold opposite lateral work margins, snags which releasably catch on the sheet material, or the like.

Referring now to FIGS. 1–4 inclusive, the fluid jet cutting means will be described in conjunction with its mounting for programmed X-Y movements parallel to the cutting bed 22. Four orthogonally spaced uprights 70 supporting the frame 12 and interconnected by cross braces 72,72 also support mechanism for effecting motion in the direction of the wires 60 (Y axis) and transversely of the wires (X axis) of a fluid jet cutting nozzle 74 and corresponding motion of its drain or receiver 76 for spent fluid. The uprights 70,70 on each side of the machine are bored to receive a pair of stationary, parallel guide rods 78,78 and a rotatable Y-axis feed screw 80. Each of the braces 72 preferably is connected to a pair of the rods 78. A casting 82 on each opposite side of the machine is formed with aligned bores for slidably receiving the pair of guide rods 78, and a central portion 83 of the castings provides a ball-screw housing for receiving the adjacent feed screw 80 axially. It will accordingly be understood that Y-motion of the castings 82 is derived from rotation of the screw 80 in appropriate direction when driven by a servo motor 84 as controlled by the programming means (not shown).

Upward projections 86,86 of each casting 82 are each bored to receive parallel guide rods 88,88 extending in the X-direction. As perhaps best seen in FIG. 3, a carriage 90 is bored for sliding movement in the X-direction on the rods 88 and supports the fluid (for instance water) jet cutting nozzle 74. For effecting X-motion of the nozzle, a servo motor 92 controlled by the programming means is arranged to rotate a feed screw 94 journalled in the opposed castings 82,82, and the screw 94 has ball screw connection with the carriage 90.

For providing corresponding Y and X motion to the drain or receiver 76, which is continually aligned for receiving effluent from the jet nozzle, the receiver is mounted on its carriage 96 (FIGS. 1,2). The latter is bored for sliding movement on parallel rods 98,98 secured in depending projections 100,100 of each of the castings 82. A servo motor 102 controlled by the programming means and rotatably driving a feed screw 104 (corresponding to the feed screw 94) journalled in the castings 82,82 moves the carriage 96 and hence the receiver in the required X direction by reason of ball-screw connection of the screw 104 with the carriage 96.

As herein shown, cutting fluid is conducted under high pressure to the nozzle 74 via hose and/or tubing 106 which may be in part held in out-of-the way position by hinged links 108,110 (FIGS. 1–3), the fluid coming from a stationary pressurized source such as at 112. The nozzle and its drain are accordingly movable as directed anywhere parallel and adjacent to the sheet W on its bed 22, a cutting program preferably dictating movement of the nozzle and drain to an inoperative side position upon termination of the cutting of a sheet.

Transfer mechanism generally designated 114 (FIGS. 1, 2, 4–6) and next to be described insures that the soles S cut from the work by the jet will be moved together with associated scrap material of their sheet onto the unloading zone 16, and without disturbance of their relative positions. For this purpose, referring chiefly to FIGS. 4 and 5, the mechanism 114 comprises an endless conveyor 116 consisting of a series of parallel belts 118 jointly movable heightwise, each belt being arranged, when raised, to extend between adjacent wires 60 as indicated in FIG. 6. The conveyor 116 comprises parallel shafts 120, 120 respectively journalled in the upper ends of opposed pairs of links 122, 122 and 124, 124 of a four-bar linkage. The lower ends of the links 122, 122 are connected to a pivot shaft rotatably supported in spaced upper ends of a yoke 126 secured to the frame 12, the links 122 are shifted angularly about their horizontal pivot axis by an air motor 128, the piston rod 130 of which is connected to rotate the pivot shaft. The lower ends of the links 124 are pivotally connected to an upper arm of a bell crank 132 pivotally supported on a pivot shaft 134 (FIG. 1) rotatably supported in the upper ends of a fixed yoke 136. The lower end of a lower arm of the bell crank 132 is connected to a piston rod 138 (FIGS. 4, 5) of an air motor 140 secured to the frame 12. The function of the bell crank upon actuation of the motor 140 is to effect further raising and a tilt of the conveyor 114 downwardly toward the unloading zone after the belts 118 have been raised between the wires 60 thus to clear cut parts and scrap from the cutting bed, whereupon a motor 142 (FIGS. 1, 4 and 5) driving one of the shafts 120 counterclockwise as seen in FIG. 6, will be automatically energized by switch means (not shown) to simultaneously convey all the cut parts and scrap in intact relation upon the belts 118 to the zone 16.

Figure 5:
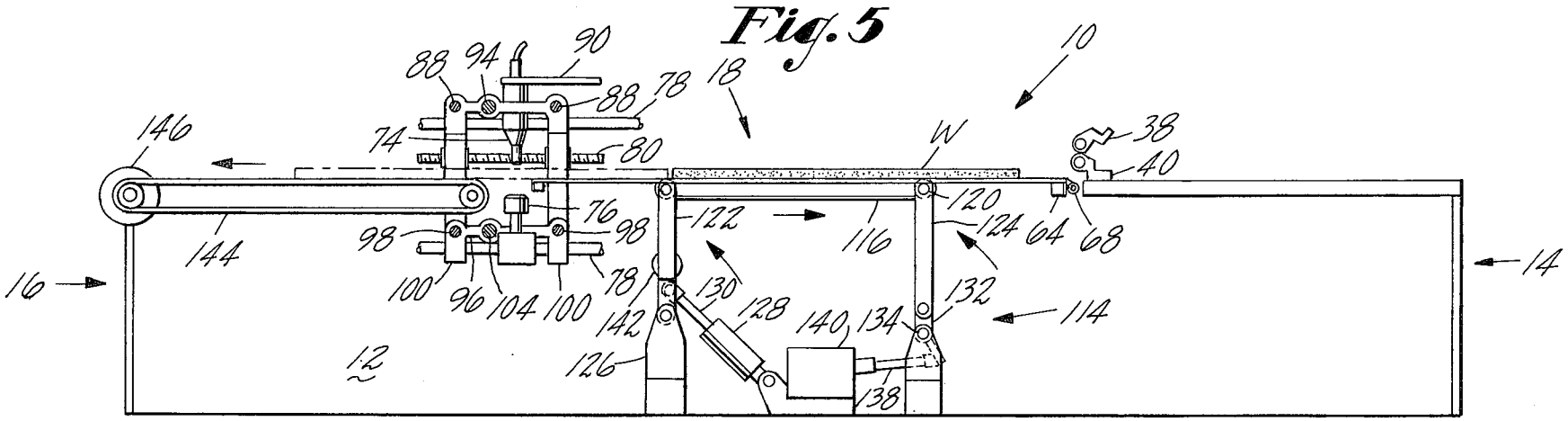
FIG. 5 is a view similar to FIG. 4 but with the work transfer mechanism elevated into operating position and the feed clamps retracted to the load zone.
Figure 8:
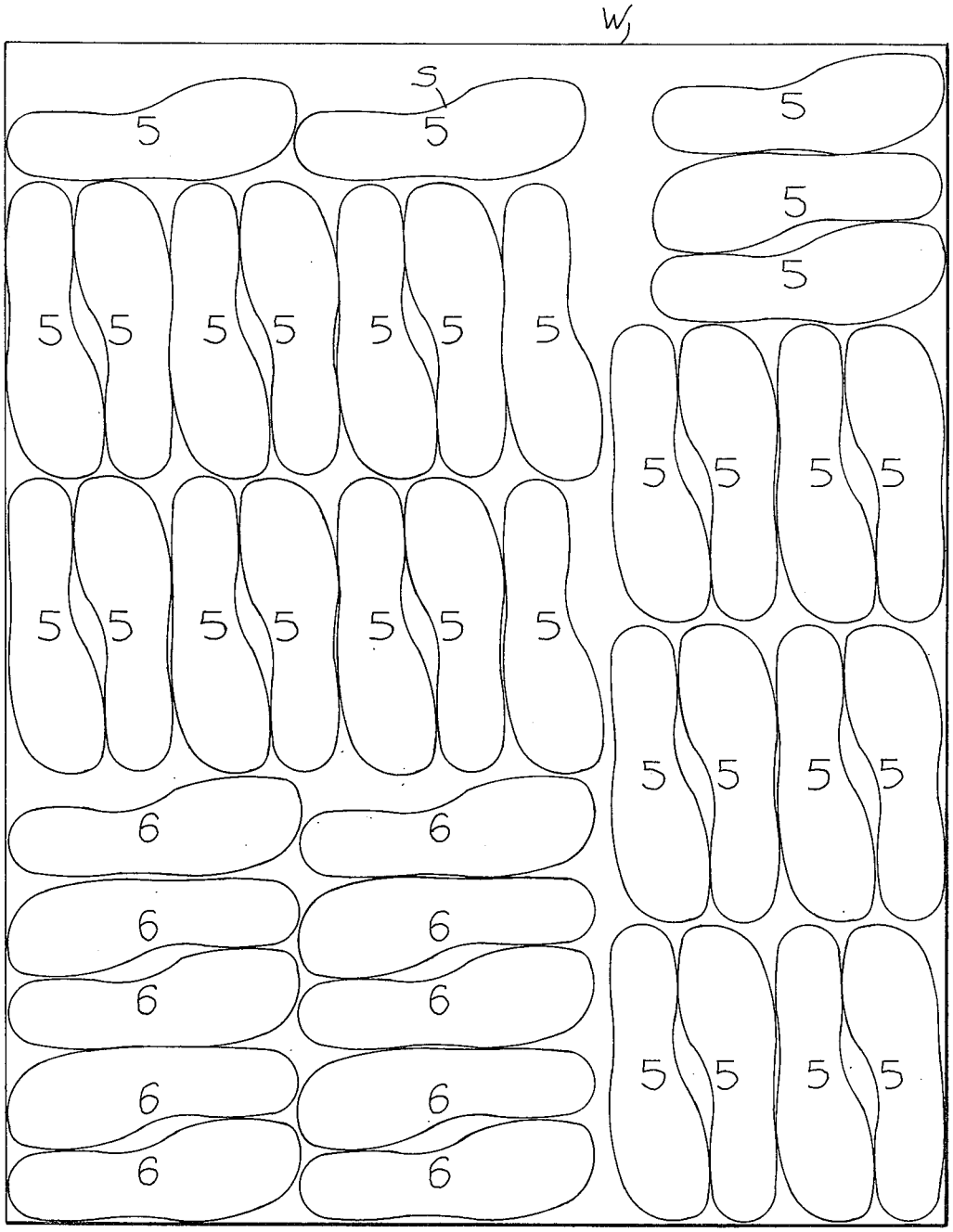
FIG. 8 is a view of a representative replica of a preprogrammed arrangement as displayed on a television screen showing, for a typical sheet, its maximum area use to provide, for instance, two particular sizes of soles and minimum scrap material.
Figure 9:
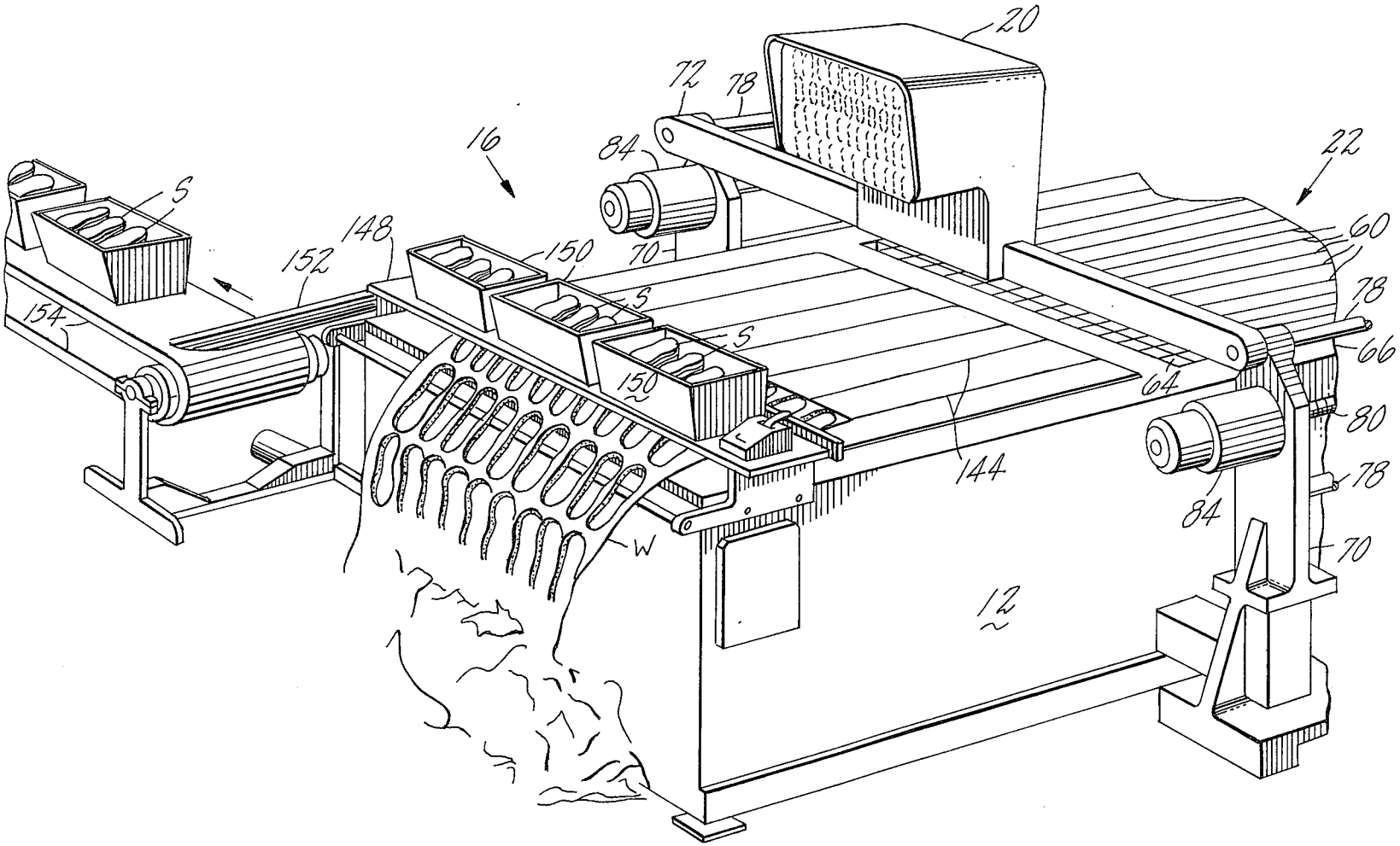
FIG. 9 is a perspective view of the unloading end of the machine whereat an operator scanning the television screen can identify the different cut-outs, for instance as indicated in FIG. 8, for assorting or further processing.

As shown in FIGS. 3–5 and 9, the zone 16 preferably comprises an endless conveyor including a plurality of parallel, flat work supporting belts 144. These belts are driven counterclockwise by a motor 146, as shown in FIGS. 3–5, under the control of the unloading attendant and may, for instance, pass beneath a stationary shelf 148 (FIG. 9) arranged to support tote boxes 150. Here an attendant may, being guided by a replica of the programmed cutting shown on the screen 20, for instance the arrangement of soles cut to sizes 5 and 6 as illustrated in FIG. 8, place the soles of one size and pattern in one box 150, and the soles of a different size and pattern in another box 150. Conveniently, these boxes with their appropriate loads may then be thrust down a ramp 152 for distribution via a conveyor 154 to other processing. The scrap from each sheet W is accumulated and otherwise disposed of.

Operation of the machine will now be briefly reviewed. A sheet W (or stack of sheets) to be cut is first placed on the loading table 14 and will, for present purposes, be assumed to have been suitably digitized when registered with the feed clamps 38, 40, they having been closed by the motors 42, 48 to seize a leading margin of the sheet. This is to say that preferably the digitizing means (not shown) provides data for an associated computer whereby useable area (for the required soles S to be cut, for instance) will be determined. A side margin of the thus loaded sheet W will also have been registered with a side gage 156 (FIGS. 1, 2) for indexing.

Next the feed motors 54 operate to cause the clamps to advance and slide the sheet from the loading table into predetermined position on the cutting bed wires 60. At such position the motors 42, 48 rotatably reverse and release the sheet, and then the motors 54, after further advancing the opened clamps sufficiently to free them from the work, reverse to return the clamps to receive a next sheet W indexed on the loading table. A hold-down means (not shown) is effective to prevent lateral work displacement on the wires 60. Preferably the programming means (not shown) predetermining X–Y directional control of the fluid jet cutter nozzle 74 to effect each cutting pattern and series of sole patterns, whether of the same or several different configurations or sizes, automatically commences the cutting upon the return of the work clamps, and on termination of the cutting of a given sheet S dictates removal of the nozzle and the receiver 76 to a side out-of-the way position (as indicated by full lines in FIG. 1) where the fluid flow may cease. FIG. 1 also shows in dash lines the means 106–112 whereby pressure fluid for cutting is delivered to the nozzle 74, its spent fluid being drained via the receiver 76. The taut wires 60 are of sufficient tensile strength to provide a firm planar support for the sheet as it is cut by the fluid being directed normal to the sheet. The diameter of the wires, for instance music wire, is sufficiently small that little or insignificant interference is provided with the spent fluid.

With the nozzle 74 and the receiver 76 out off the way, the transfer mechanism 114 is next operated to move the soles S and scrap intact from the bed 22 to the unloading zone. To minimize non-productive time, the inoperative conveyor 116 is promptly raised as indicated in FIG. 4, by the motor 128 to a position just under the bed 22 by means of the four-bar linkage 122, 124. Now the motor 140 is energized shifting the bell crank 132 counterclockwise as shown in FIG. 5. This causes each of the conveyor belts 118 to tilt upwardly between adjacent pairs of the wires 60, to lift both cut soles S and scrap, while intact, above the wires. Thereupon the motor 142 is energized causing the conveyor 116 to deliver in assembled relation, as duplicatively shown on the screen 20 (FIG. 9), the soles and scrap to the unloading conveyor belts 144. The unloading attendant, when ready, will energize the motor 146, being guided by the screen replica (such as shown in FIG. 8) and can identify the different cut parts (and, if desired, read their destination) and accordingly proceed with further distribution or other appropriate processing.

It will be apparent from the foregoing that the invention provides a high-production sheet cutting machine for many industrial applications.

Having thus described our invention, what we claim as new and desire to secure as Letters Patent of the United States is:

1. In a machine for cutting sheet material by means of a fluid jet cutter movable in a plane, a main frame, a cutting bed mounted on the frame to support the sheet material substantially parallel and adjacent to said plane and normal to the jet from the cutter, the bed being comprised of a plurality of spaced, parallel, taut wires respectively having a tensile strength adequate to fully counter any tendency of the jet to displace successive cutting localities of the material.

2. In a machine for cutting sheet material and having a main frame with a loading zone at one end thereof and an unloading zone disposed at an opposite end, a movable fluid jet cutter mounted on the frame and operable in a horizontal plane intermediate said zones, an effluent receiver mounted on the frame for movement a substantially fixed distance beneath said plane, means for correspondingly controlling X–Y motion of the cutter and the receiver in their respective planes, and a cutting bed disposed between said zones, and between the cutter and the receiver, said bed comprising a plurality of uniformly spaced, substantially unidirectional wires tautly extending between the zones.

3. A machine as in claim 2 wherein the bed wires are anchored at their respective opposite ends to a bed frame detachably mounted on the main frame, and means is provided for taking up any slackness in each of the wires.

4. A machine as in claim 2 further comprising mechanism disposed, when inoperative, beneath said bed and movable heightwise thereof to transfer to the unloading zone in intact relation the cut workpieces and scrap from said sheet material after operation thereon by the jet cutter.

5. A machine as in claim 2 further comprising transfer means operable, upon removal of the cutter and receiver to an out-of-the way position after cutting of a sheet is completed, to carry intact from the cutting bed both cut workpieces and the scrap of the sheet, the transfer means comprising a multi-belt conveyor movable between an inoperative position beneath the bed to an operative position above the wires thereof, the belts being respectively of a width slightly less than the spacing between adjacent wires, and means for operating the conveyor after it is raised above the wires to transfer the cut pieces and scrap to said unloading zone.

6. A machine as in claim 5 wherein the transfer mechanism includes power means for moving the conveyor between said inoperative and operative positions, said power means including a four-bar linkage, and drive mechanism for moving the conveyor when its belts are above said wires.

7. A machine as in claim 6 wherein said power means further comprises a bell crank connected to the four-bar linkage, and a motor means for actuating the bell crank to uniformly tilt the conveyor belts relative to the bed after they have raised the work therefrom and before the conveyor is operated to transfer the work intact to the unloading zone.

8. A machine for predeterminedly cutting sheet material to provide a plurality of similar and/or dissimilar cut workpieces therefrom comprising a main frame, a planar cutting bed mounted horizontally on the frame intermediate a loading and an unloading zone of the machine, the bed comprising parallel, taut wires extending substantially between said zones and being spaced on the order of about one inch apart, a fluid jet cutter movably mounted on the frame above said bed for motion in an X–Y plane substantially parallel to said bed wires and adjacent thereto, an effluent receiver mounted on the frame beneath said bed wires and adjacent thereto, programmed means for correspondingly moving the cutter and the receiver in their respective planes during jet cutting of sheet material disposed on said bed, sheet material feeding means including at least one pair of closeable clamps movable between a work-gripping position at the loading zone and a work-releasing position over said bed, a transfer mechanism movable heightwise from a position beneath the bed and including a multi-belt endless conveyor, said mechanism comprising a four-bar linkage for raising the belts of said conveyor substantially to the level of said wires, and a bell crank pivotally connected to the linkage for tilting the raised conveyor respectively, between and at least partly above the adjacent bed wires, power means for operating said linkage, and then actuating the bell crank to cause the raised conveyor belts to separate the cut workpieces and scrap intact from the bed wires, and other power means for thereupon driving the conveyor when thus tilted to deliver the cut pieces and scrap intact to the unloading zone.

9. A machine as in claim 8 further comprising, at the unloading zone, a television screen for showing a replica of the predetermined parts to be cut from the sheet material in accordance with the operation of said programmed means, whereby an attendant can identify and remove the parts for further appropriate processing.

* * * * *